US009149137B2

(12) United States Patent
Liddick

(10) Patent No.: US 9,149,137 B2
(45) Date of Patent: Oct. 6, 2015

(54) DUAL-PANELED BEDDING SYSTEM

(71) Applicant: Dawn Liddick, Lykens, PA (US)

(72) Inventor: Dawn Liddick, Lykens, PA (US)

( * ) Notice: Subject to any disclaimer, the term of this patent is extended or adjusted under 35 U.S.C. 154(b) by 0 days.

(21) Appl. No.: 14/315,873

(22) Filed: Jun. 26, 2014

(65) Prior Publication Data

US 2015/0196146 A1 Jul. 16, 2015

Related U.S. Application Data

(60) Provisional application No. 61/927,035, filed on Jan. 14, 2014.

(51) Int. Cl.
*A47G 9/02* (2006.01)
*A47G 9/04* (2006.01)

(52) U.S. Cl.
CPC ..... *A47G 9/0246* (2013.01); *A47G 9/023* (2013.01); *A47G 9/04* (2013.01)

(58) Field of Classification Search
CPC ..... A47G 9/02; A47G 9/0207; A47G 9/0223; A47G 9/023; A47G 9/0238; A47G 9/0246; A47G 9/04; A47C 31/105
USPC ..... 5/486, 496–500, 502
See application file for complete search history.

(56) References Cited

U.S. PATENT DOCUMENTS 3,331,088 A 7/1967 Marquette
3,508,284 A * 4/1970 Marquette ..... 5/486
3,508,285 A * 4/1970 Marquette ..... 5/486
5,287,573 A * 2/1994 Ritacco ..... 5/486
D359,871 S * 7/1995 Fortran ..... D6/603
D379,893 S * 6/1997 Dilbeck ..... D6/602
6,643,872 B1 11/2003 Buswell
6,862,760 B2 3/2005 Bradley et al.
D507,919 S * 8/2005 Bishop ..... D6/596
7,124,455 B2 * 10/2006 Demarco et al. ..... 5/486
7,200,883 B2 4/2007 Hagerty
D562,046 S * 2/2008 Yeargin ..... D6/603
2005/0268399 A1 * 12/2005 Demarco et al. ..... 5/486
2005/0273930 A1 * 12/2005 Phillipps ..... 5/486
2006/0059622 A1 * 3/2006 Haggerty ..... 5/486
2006/0282950 A1 * 12/2006 Shuster et al. ..... 5/486
2007/0157383 A1 * 7/2007 Burns ..... 5/486
2012/0233778 A1 9/2012 Shull et al.

OTHER PUBLICATIONS

Gershman, Maurice, M.D. "Self-Adhering Nylon Tapes." Journal of A.M.A. (vol. 168, No. 7) Oct. 18, 1958.*

* cited by examiner

*Primary Examiner* — Robert G Santos
(74) *Attorney, Agent, or Firm* — Daniel Boudwin; Global Intellectual Property Agency LLC

(57) ABSTRACT

Described is a dual-paneled bedding system that includes a fitted sheet, a bed sheet, and one or more pillowcases. The bed sheet is rectangular and includes a first panel attached to a second panel by means of a line of stitching. The first panel is composed of a first material, and the second panel is composed of a second material, wherein the first material is warmer or more insulating than the second material. The fitted sheet is similar in construction to the bed sheet but includes an elastic band around the perimeter thereof. A first pillowcase is be composed of the first material, while a second pillowcase is composed of the second material. The present invention allows two users to share a single sheet set wherein a first user can be covered by the warmer first panel and a second user can be covered by the lighter second panel.

6 Claims, 2 Drawing Sheets

DUAL-PANELED BEDDING SYSTEM

CROSS REFERENCE TO RELATED APPLICATION

This application claims the benefit of U.S. Provisional Application No. 61/927,035 filed on Jan. 14, 2014, entitled "Flip for Flannel." The above identified patent application is herein incorporated by reference in its entirety to provide continuity of disclosure.

BACKGROUND OF THE INVENTION

1. Field of the Invention

The present invention relates to a dual-paneled bedding system. More specifically, the present invention describes a bedding system comprising a fitted sheet and a bed sheet, wherein each sheet comprises two panels composed of different materials, and wherein the materials differ in warmth or heat retention, such that one panel is warmer than the other.

People commonly share a bed with their significant other or spouse. However, each person may desire a blanket that provides a different amount of warmth in order to sleep comfortably. For example, one person may be cold and may desire a heavy blanket, whereas the other person may be warm and may desire a lighter blanket. Thus, when the first and second persons share a bed and have a single blanket or comforter, one or both of the individuals may become uncomfortable due to the warmth or heat retention of the blanket. As a result, one person may attempt to wrap themselves in a greater proportion of the blanket in order to achieve a comfortable sleeping temperature, and the other person may be forced to uncover himself or herself in order to be comfortable. Alternatively, the person who prefers to be warm may want to use an additional blanket for warmth, but adding another blanket to the bed may make the other person uncomfortable.

Additionally, individuals who sleep alone may become uncomfortable during the night as the temperature fluctuates. A room may become colder during the night as the outdoor temperature decreases. Alternatively, a person may become warm throughout the night from being covered in blankets for an extended period of time. Thus, individuals may also remove blankets and reapply blankets throughout the night in an attempt to achieve a comfortable sleeping temperature.

The present invention provides a dual-paneled bedding system comprising a fitted sheet and a bed sheet. Each sheet comprises a first panel and a second panel, wherein the panels are secured together by a line of stitching. Each panel is roughly half of the sheet, and each panel is composed of a different material so that the panels provide differing levels of warmth, insulation, or heat retention. In this way, a first user can be covered with a first panel of the sheet that is relatively thick and insulating, and the second user can be covered with the second panel of the sheet that is relatively thin. Thus, two users can share a bed and rest comfortably despite desiring different levels of warmth. In some embodiments of the invention, at least one of the panels includes fasteners thereon that are adapted to engage with an upper sheet so as to allow a user to increase the warmth or thickness of only one panel of the sheet.

2. Description of the Prior Art

Devices have been disclosed in the prior art that relate to blankets or bedding systems. These include devices that have been patented and published in patent application publications. These devices generally relate to blankets having two sections with different levels of warmth or heat retention. The following is a list of devices deemed most relevant to the present disclosure, which are herein described for the purposes of highlighting and differentiating the unique aspects of the present invention, and further highlighting the drawbacks existing in the prior art.

One such device, U.S. Pat. No. 6,862,760 to Bradley et al. discloses a dual warmth comforter having a first section secured to a second section by a fastening device, such as Velcro, a zipper, buttons, snaps, or laces. Each section includes a pair of fabric sheets with insulating material disposed therebetween. The first section has a thermal resistance greater than the second section. Thus, Bradley fails to disclose a bedding system comprising a bed sheet and a fitted sheet, wherein each sheet has a first panel permanently affixed to a second panel by a line of stitching.

U.S. Pat. No. 7,200,883 to Haggerty discloses a bedding system comprising a fitted sheet with two sections, each composed of a different fabric, and a bed sheet having two sections, each composed of a different fabric. The two sections are secured together by partial stitches on the head and toe ends of the sections, and a partial split or opening is disposed therebetween. Thus, Haggerty fails to disclose a bedding system having a removable sheet comprising two sections that are permanently secured together by a continuous line of stitching. Further, Haggerty does not disclose a bedding system that allows users to secure additional layers of fabric or insulating material thereto.

U.S. Pat. No. 6,643,872 to Buswell discloses a comforter having two halves with different warmth retentiveness. Each half is filled with two distinct fillers, which differ in heat retention but are similar in loft and thus provide a similar outward appearance to the user. The two halves are separated by stitching that prevents the filler from moving from one half to the other. Thus, while Buswell discloses a comforter having two halves with differing warmth retention, Buswell discloses the use of a filler material disposed within each section. Thus, Buswell fails to disclose a bedding system that allows a user to removably secure additional layers or sheets of fabric to one half of a sheet or comforter.

U.S. Pat. No. 3,331,088 to Marquette discloses a bed covering comprising a blanket with removably attachable top panels. The top panels can be partly folded toward the foot of the bed or moved to the right of left of the user by unfastening an edge of the blanket. Further, a pair of half panels for the foot portion of each main panel can be attached and detached as desired by means of fasteners. Thus, while Marquette discloses a bed covering having removable panels, Marquette fails to disclose a bed sheet and fitted sheet comprising a first panel composed of a first material and a second panel composed of a second material that is more insulating than the first material.

Finally, U.S. Patent Application Publication Number 2012/0233778 to Shull et al. discloses a multiple panel blanket. The blanket includes a base panel and at least one upper panel disposed thereon. The upper panels are attached to the base panel along at least a portion of the sides of the base panel. Thus, Shull et al. fails to disclose a bedding system having a sheet wherein one half is secured to a second half by means of a line of stitching, and wherein each half has a different level of warmth or heat retention.

These prior art devices have several known drawbacks. Some devices in the prior art disclose bedding systems having two sections with different amounts or types of filler material. Such bedding systems only provide a comforter and do not disclose sheets and fitted sheets to be disposed on a bed. Further, many devices in the prior art do not allow users to add additional layers of fabric thereon in order to adjust the warmth of one half of the blanket. Thus, such systems are not as versatile as the bedding system of the present invention.

In light of the devices disclosed in the prior art, it is submitted that the present invention substantially diverges in design elements from the prior art and consequently it is clear that there is a need in the art for an improvement to existing bedding systems having different levels of warmth. In this regard the instant invention substantially fulfills these needs.

SUMMARY OF THE INVENTION

In view of the foregoing disadvantages inherent in the known types of bedding now present in the prior art, the present invention provides a new dual-paneled bedding system wherein the same can be utilized for providing convenience for the user when sharing a bed with another user.

It is therefore an object of the present invention to provide a new and improved dual-paneled bedding system that has all of the advantages of the prior art and none of the disadvantages.

It is another object of the present invention to provide a dual-paneled bedding system comprising a bed sheet or fitted sheet having a first panel composed of a first material and having a second panel composed of a second material, wherein said first material is heavier or is more insulating.

Another object of the present invention is to provide a dual-paneled bedding system having a bed sheet or fitted sheet comprising a first panel secured to a second panel by a line of stitching that provides a uniform and smooth exterior surface.

Yet another object of the present invention is to provide a bed sheet having a first panel and a second panel, wherein a user can add additional layers to one of the panels so as to increase the warmth of that panel without affecting the other panel.

Another object of the present invention is to provide a dual-paneled bedding system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
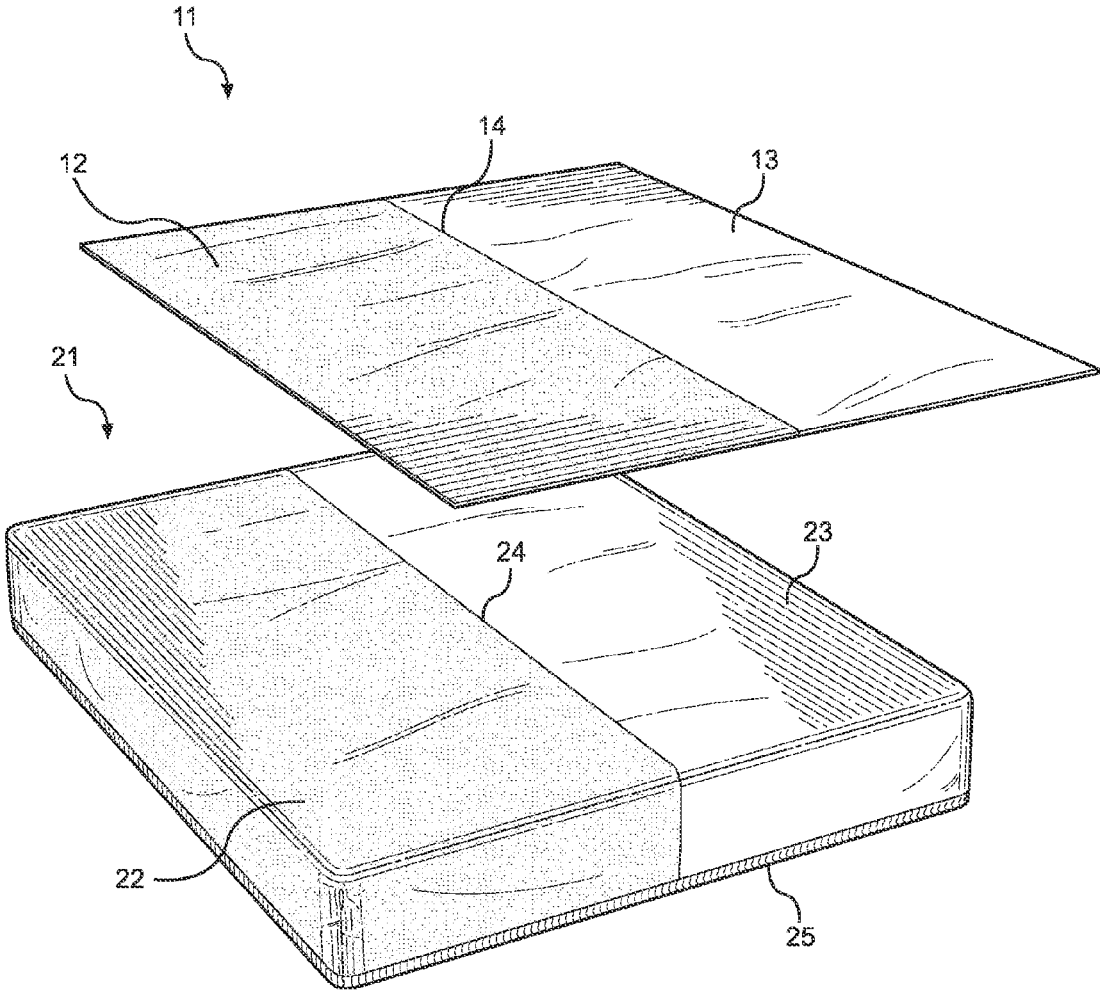
FIG. 1 shows a perspective view of the bed sheet and the fitted sheet of the present invention as disposed on a mattress.

Reference is made herein to the attached drawings. Like reference numerals are used throughout the drawings to depict like or similar elements of the bedding system. For the purposes of presenting a brief and clear description of the present invention, the preferred embodiment will be discussed as used for providing users with dual-paneled bedding to allow users to sleep comfortably. The figures are intended for representative purposes only and should not be considered to be limiting in any respect.

Referring now to FIG. 1, there is shown a perspective view of the bed sheet and the fitted sheet of the present invention as disposed on a mattress. The bedding system of the present invention comprises a bed sheet 11, a fitted sheet 21, and one or more pillow cases. The bed sheet 11 is substantially rectangular and includes a single layer of material. The bed sheet 11 comprises a first panel 12 composed of a first material and a second panel 13 composed of a second material. Preferably, the first panel 12 corresponds to half of the bed sheet 11 and the second panel corresponds to the second half of the bed sheet 11. Preferably, the first material is more insulating, thicker, or warmer than the second material, or vice versa. For instance, the panels of the present invention may be composed of cotton, flannel, silk fiber, sateen, satin, muslin, wool, or other suitable fabric. This allows a user to select which side of the bed sheet 11 to use while sleeping, depending upon the amount of warmth desired. Alternatively, the bed sheet 11 allows two users who desire different levels of warmth to sleep comfortably using a single bed sheet.

The first panel 12 is secured to the second panel 13 along a single side thereof by means of a line of stitching 14. Each panel is substantially rectangular, and the stitching 14 extends along the length of each panel, on a side thereof. The stitching 14 is preferably substantially parallel to a side of the panels 12, 13. In a preferred embodiment of the bed sheet 11 of the present invention, the stitching 14 is seamless so that users cannot feel the stitching 14 while lying in bed underneath the bed sheet 11. Thus, the stitching 14 comprises a smooth surface that cannot be detected by a user sleeping underneath the sheet.

The fitted sheet 21 is substantially the same as the bed sheet 11, but the fitted sheet 21 further comprises an elastic or stretchable band 25 disposed about the perimeter thereof. The stretchable band 25 allows the fitted sheet 21 to fit snugly on a mattress so that it can be secured in position thereon. Similar to the bed sheet 11, the fitted sheet 21 is rectangular and comprises a single layer of material. The fitted sheet 21 comprises a first panel 22 secured to a second panel 23, wherein the first panel 22 is composed of a first material and the second panel 23 is composed of a second material. Preferably, the first material is more insulating, thicker, or warmer than the second material, or vice versa. The first panel 22 is secured to the second panel 23 along a single side thereof by means of a line of stitching 24.

The bed sheet 11 and the fitted sheet 21 may be used together or separately. When used together, the bed sheet 11 and the fitted sheet 21 may be aligned so that the first panel 12 of the bed sheet 11 is placed over the first panel 22 of the fitted sheet 21 and the second panel 13 of the bed sheet 11 is placed over the second panel 23 of the fitted sheet 21. As such, each of the panels of the bed sheet 11 and the fitted sheet 21 is substantially equal in dimension and size. As disclosed above, in some embodiments, the present invention may further comprise a first pillowcase that is composed of the first material, and a second pillowcase that is composed of the second material. Preferably, the material of the pillowcase corresponds with the material of the panel on which the pillowcase is placed.

Figure 2:
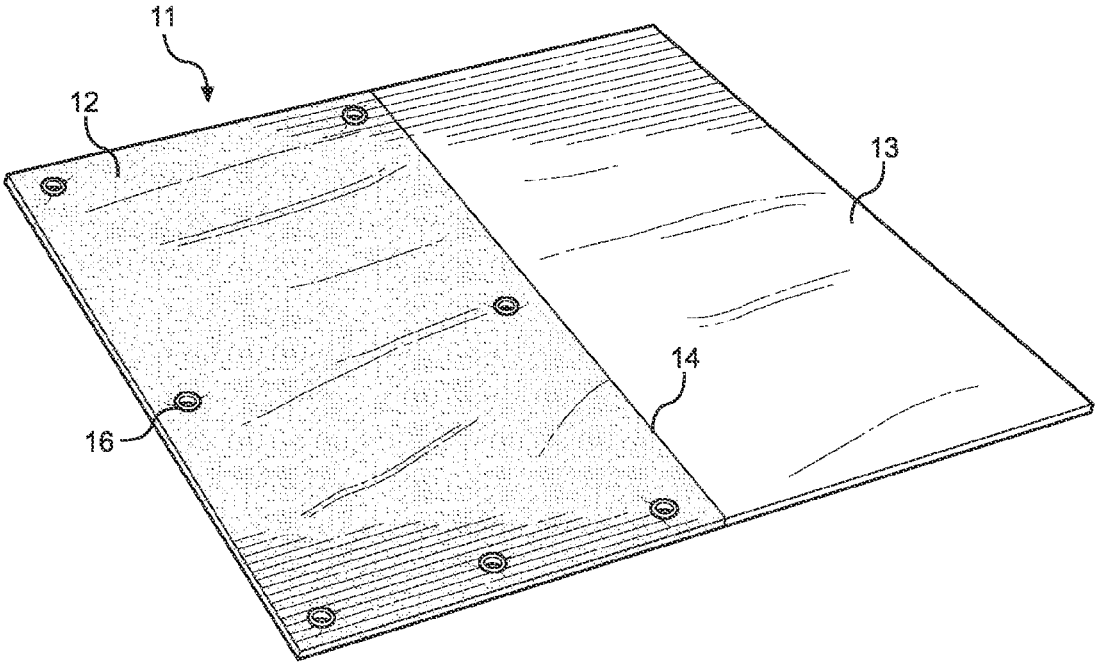
FIG. 2 shows a view of an embodiment of the bed sheet of the present invention having fasteners thereon.

Referring now to FIG. 2, there is shown a view of an embodiment of the bed sheet of the present invention having fasteners thereon. In the illustrated embodiment, the bed sheet 11 further comprises a plurality of fasteners 16 thereon. The fasteners 16 are disposed on an upper surface of at least one panel of the bed sheet 11. Preferably, the fasteners 16 are disposed about the perimeter of the bed sheet 11 and along the stitching 14. In some embodiments, fewer fasteners 16 are disposed on the upper end or head end of the sheet so as to minimize the user's contact with the fasteners 16 when sleeping. The fasteners 16 are adapted to secure an upper sheet to one panel of the bed sheet 11. In this way, users can selectively add an upper sheet composed of any of a variety of materials so as to provide additional warmth or thickness to one panel of the bed sheet 11. This allows users to independently adjust the warmth of one panel of the bed sheet 11, without requiring the second user to also adjust the warmth of the other panel of the bed sheet 11.

Figure 3:
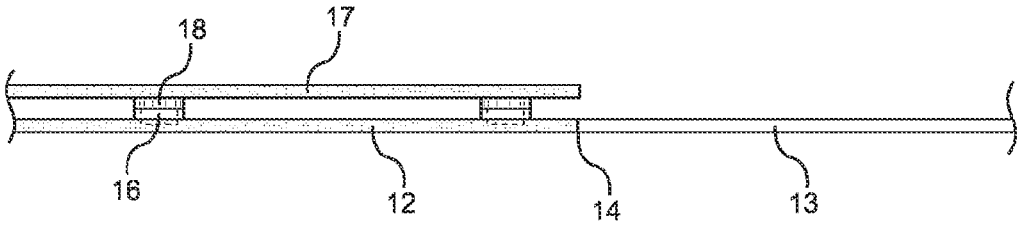
FIG. 3 shows a cross-sectional view of an embodiment of the bed sheet of the present invention with an upper sheet attached thereto.

Referring now to FIG. 3, there is shown a cross-sectional view of an embodiment of the bed sheet of the present invention with an upper sheet attached thereto. At least one of the panels includes fasteners 16 on a surface thereof for securing an upper sheet 17 thereto. The upper sheet 17 comprises a rectangular panel that is sized similarly to the panel on the bed sheet to which it can be secured. Thus, the upper sheet 17 does not extend beyond the stitching 14, leaving the second panel 13 free of an additional layer of fabric. The upper sheet 17 can be composed of any suitable material, and serves to add warmth to one panel of the bed sheet.

Any variety of fasteners can be used such as a zipper, snaps, buttons, clasps, among others. In the illustrated embodiment, the first panel 12 comprises female snaps 16 on an upper surface thereof that are adapted to receive male snaps 18 disposed on a lower surface of an upper sheet 17. The upper sheet 17 is sized so as to overlap and be coextensive with one panel of the bed sheet. The male snaps 18 on the upper sheet 17 are disposed on the perimeter of the upper sheet 17 and align with the female snaps 16 on the first panel 12. In this way, a user can easily align the male 18 and female 16 snaps on the upper sheet 17 and first panel 12, respectively, in order to removably secure the upper sheet 17 to the bed sheet. When the upper sheet 17 is secured to the bed sheet 11, the snaps 16, 18 are disposed in between the bed sheet and upper sheet 17 so that the user does not contact the snaps 16, 18. Thus, the user sleeping underneath the bed sheet will not come into contact with the fasteners and will not be disturbed thereby.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual-paneled bedding system, comprising:

a fitted sheet comprising a first panel secured to a second panel, wherein said first panel is composed of a first material and wherein said second panel is composed of a second material, wherein said first material has greater warmth retention than said second material;

wherein said fitted sheet further comprises a stretchable band disposed about the perimeter thereof;

a bed sheet comprising a third panel having an upper surface secured to a fourth panel having an upper surface, wherein said third panel is composed of said first material, said fourth panel is composed of said second material, and the upper surface of either one of said third or said fourth panel comprises a plurality of fasteners thereon;

an upper sheet having a lower surface with a plurality of fasteners thereon, said lower surface adapted to be removably secured to the upper surface of at least one of said third panel or said fourth panel via engagement between said plurality of fasteners disposed on said upper surface of one of said third or said fourth panel and said plurality of fasteners disposed on said lower surface of said upper sheet;

wherein removal of said upper sheet results in complete separation between said upper sheet and at least one of either said third or fourth panel.

2. The dual-paneled bedding system of claim 1, wherein:

said first panel is secured to said second panel by means of a line of stitching that secures a side of said first panel to a side of said second panel; and said third panel is secured to said fourth panel by means of a line of stitching that secures a side of said third panel to a side of said fourth panel.

3. The dual-paneled bedding system of claim 2, wherein each of said line of stitching between said first panel and said second panel and said line of stitching between said third panel and said fourth panel creates a smooth surface.

4. The dual-paneled bedding system of claim 1, wherein said plurality of fasteners on said upper sheet and said plurality of fasteners on said at least one of said third panel or said fourth panel comprise button snaps.

5. The dual-paneled bedding system of claim 1, wherein:

said plurality of fasteners on said upper sheet are disposed about a perimeter thereof; and said plurality of fasteners on said at least one of said third panel or said fourth panel are disposed about the perimeter of said third panel or the perimeter of said fourth panel.

6. The dual-paneled bedding system of claim 1, wherein said first material is cotton and said second material is flannel.

* * * * *